US007861663B2

(12) United States Patent
Sedlack, II

(10) Patent No.: US 7,861,663 B2
(45) Date of Patent: Jan. 4, 2011

(54) BOARDING LADDER FOR INFLATABLE WATERCRAFT

(75) Inventor: Russell L. Sedlack, II, Port St. Lucie, FL (US)

(73) Assignee: Vallery Industries, Inc., Stuart, FL (US)

( * ) Notice: Subject to any disclaimer, the term of this patent is extended or adjusted under 35 U.S.C. 154(b) by 43 days.

(21) Appl. No.: 12/396,220

(22) Filed: Mar. 2, 2009

(65) Prior Publication Data

US 2010/0219019 A1 Sep. 2, 2010

(51) Int. Cl.
*B63B 17/00* (2006.01)

(52) U.S. Cl. ..... 114/362; 182/86; 182/97

(58) Field of Classification Search ..... 114/343, 114/362; 182/86, 88, 93, 95, 97, 106, 116, 182/163

See application file for complete search history.

(56) References Cited

U.S. PATENT DOCUMENTS

| | | | | |
|---|---|---|---|---|
| 4,186,820 | A | 2/1980 | Cosman et al. | |
| 4,541,507 | A | 9/1985 | Gibellato | |
| 4,572,330 | A | 2/1986 | Langevin | |
| 4,719,872 | A | 1/1988 | Ritten | |
| 4,723,929 | A | 2/1988 | Parish | |
| 4,989,691 | A | 2/1991 | Wilkerson et al. | |
| 5,117,940 | A | 6/1992 | Garelick | |
| 5,287,945 | A | 2/1994 | Thurlow | |
| 5,887,540 | A | 3/1999 | Krish, Jr. | |
| 6,021,733 | A | 2/2000 | Jaramillo, Sr. | |
| 6,058,875 | A * | 5/2000 | Krish, Jr. | 114/362 |
| 6,651,776 | B2 | 11/2003 | Montecer, Jr. | |
| 6,948,588 | B1 | 9/2005 | Chustak | |

* cited by examiner

*Primary Examiner*—Lars A Olson
(74) *Attorney, Agent, or Firm*—Dennis T. Griggs; Scott T. Griggs; Griggs Bergen LLP

(57) ABSTRACT

A portable boarding ladder is attached to a rubberized portion of an inflatable boat without the use of piercing fasteners and does not require a hard point mounting structure. A base ladder section and a climbing ladder section are pivotally coupled together and supported in an operative, stand-off boarding position along a curved hull surface of a pontoon boat by a pair of hook support brackets and a pair of latch retainer brackets. The support brackets are bonded to the pontoon by adhesive deposits. A lateral cross bar tubing segment of the base ladder section is supported by hanging engagement on the hook brackets. A pair of side rail tubing segments of the climbing ladder section are retained and secured against lateral shifting displacement and rotation relative to the pontoon by snap-fit engagement against resilient arm portions of the latch retainer brackets.

21 Claims, 16 Drawing Sheets

BOARDING LADDER FOR INFLATABLE WATERCRAFT

BACKGROUND OF THE INVENTION

1. Field of the invention

This invention is related to watercraft boarding ladders, and in particular to a folding ladder assembly that can be hung off the side of inflatable boats or rubberized boats, for example a pontoon boat, dinghy, life raft, runabout, rescue, marine patrol, offshore work boat or comparable thin-hull watercraft, for use by divers and swimmers while boarding from open water.

2. Description of the related art

The ability to move onto a boat easily and safely is essential for obvious reasons. On the dock, a stable platform enables safe and convenient boarding alongside a boat. On open water, however, boarding is difficult and in most cases requires above average personal strength and on-board assistance as well. For this reason, most small watercraft are equipped with a boarding ladder of some kind, either permanently attached, or portable and stowed away for set-up and service as needed.

Conventional boarding ladders intended for permanent installation require a hard point load reaction structure and a substantial amount of available deck space for installation. Consequently, fixed boarding ladders are not well adapted for installation on small rubberized or inflatable boats that are subject to puncture damage. For example, a conventional pontoon boat, dinghy or a life raft has a rubberized hull that is sealed airtight and should not be pierced by fasteners. Likewise, some small runabouts or sailboats have a hull or deck made of a fiberglass material that is not capable of reacting high shear loads, thus making them vulnerable to fatigue failure and rupture.

Conventional boarding ladders of the portable kind are available in two categories: flexible (rope) ladders and rigid frame (hook) ladders. Rope ladders are easy to store and require no mounting hardware, but require exceptional physical strength to use successfully. They lack center or bottom stability and swing easily from side-to-side along the side of the hull, as well as to-and-fro beneath the hull. This makes rope ladders extraordinarily difficult to use even with on-board assistance, especially under open water conditions where the boat will be undergoing bobbing, rolling and pitching movement.

For these reasons, hook style ladders are generally preferred since they provide a stable climbing structure relative to the hull of the boat. However, the attachment of a conventional hook style boarding ladder requires a hard point reaction structure that can engage a penetrating fastener and withstand substantial shearing loads without rupture. The only hard point reaction structure available on some inflatable boats and fiberglass boats is the transom. In some smaller boats only a limited amount of space is available since the transom is almost completely occupied by an outboard motor.

Conventional boarding ladders are frequently mounted about midway along a gunnel or pontoon of small watercraft. The side mounting location may not always be available on smaller boats, since the outwardly projecting components of conventional boarding ladders may strike the dock and interfere with safe docking, or become entangled with dock rigging during docking maneuvers.

Fixed boarding ladders cannot be easily removed for storage, since they are permanently fastened to the deck and require tools for removal. Others provide only a short extension into the water, with the result that acquiring a foothold may be difficult. Other boarding ladders have included collapsible features which allow them to be reduced to compact size for storage and extended to full size for service. Those features include, for example, hinges, sliding extensions and flexible sides made of chain or rope.

Because of their construction and the desire to provide a compact assembly, conventional boarding ladders often do not provide a secure foothold below water and may not provide an adequate handhold above the water line. Using such ladders is a challenge to young persons as well as elderly, those carrying aquatic gear, such as SCUBA diving equipment or water skis, and even those persons who are in good physical condition but who may be exhausted after engaging in water sport activities, or when the ladder may be used in a man-over-board rescue emergency.

Other limitations of boarding ladders of conventional design have involved the manner in which they are attached to the boat. In particular, since compact size is generally desirable, some conventional ladders intended for marine use simply extend up to the nearest available mounting surface, for example the lower side of the gunwale. Moreover, no provision is made for quick removal and stowage when the boarding ladder is not needed.

Many conventional boarding ladders have design features that improve their usability on larger boats, especially those that are permanently fastened onto a hard deck or solid hull. However, such boarding ladders cannot be installed on inflatable, rubberized, or thin-hull vessels, which are vulnerable to piercing, puncture and rupture damage. Conventional fixed boarding ladders encroach on available deck space, and cannot be quickly or easily removed.

BRIEF SUMMARY OF THE INVENTION

The boarding ladder assembly of this invention is portable and can be quickly installed in the operative boarding position onto a perimeter surface of an inflatable boat or a thin-hulled boat without piercing the hull. The ladder components of the assembly are constructed of lightweight metal tubing configured in a climbing ladder section and a base ladder section. The climbing ladder section and the base ladder section are coupled together in a pivotal union for folding and unfolding movement between open and closed positions. When the boarding ladder is installed in the operative boarding position, the climbing ladder section hangs downwardly from the base ladder section in stand-off relation to the side of the boat.

The boarding ladder is secured to the side of a boat in the operative, stand-off boarding position by one or more base retainer brackets and one or more latch retainer brackets. According to one embodiment, each base retainer bracket has a curved hook portion and a pocket for receiving and retaining a tubing segment of the base ladder section. According to another embodiment, each base retainer bracket includes a hard-point mounting plate and a pocket for engaging a coupling pin carried on a lateral crossbar segment. Each latch retainer bracket includes a pair of resilient arm portions that grip and retain a climbing ladder side rail tubing segment.

The base retainer brackets and the latching brackets have body portions made of durable, molded rubber material that are permanently attached to the side of the boat by an adhesive deposit. A lateral cross bar tubing segment of the base ladder section is positively retained and secured against downward displacement and inboard/outboard rotation relative to the boat sidewall by engagement within the pockets of the base retainer brackets. The boarding ladder is supported and secured against lateral displacement and in stand-off relation to the boat sidewall by snap-fit engagement of the climbing ladder side rail tubing segments with the latch retainer brackets.

The boarding ladder can be quickly released from engagement with the latch retainer brackets in response to manual inboard closing rotation of the ladder assembly. The boarding ladder may be removed from engagement with the base retainer brackets in response to a straight manual pull of the base ladder section in the inboard direction and out of engagement with the coupling pockets.

The top cross bar, hinge bar and side rail tubing segments of the climbing ladder section serve as above-water handholds. The upper base retainer brackets and lower latch retainer brackets maintain a stand-off spacing of the ladder sections relative to the boat, thereby providing hand-hold space and foot support space, as well as preventing rubbing contact of the boarding ladder sections against the side of the boat.

DETAILED DESCRIPTION OF THE INVENTION

Figure 1:
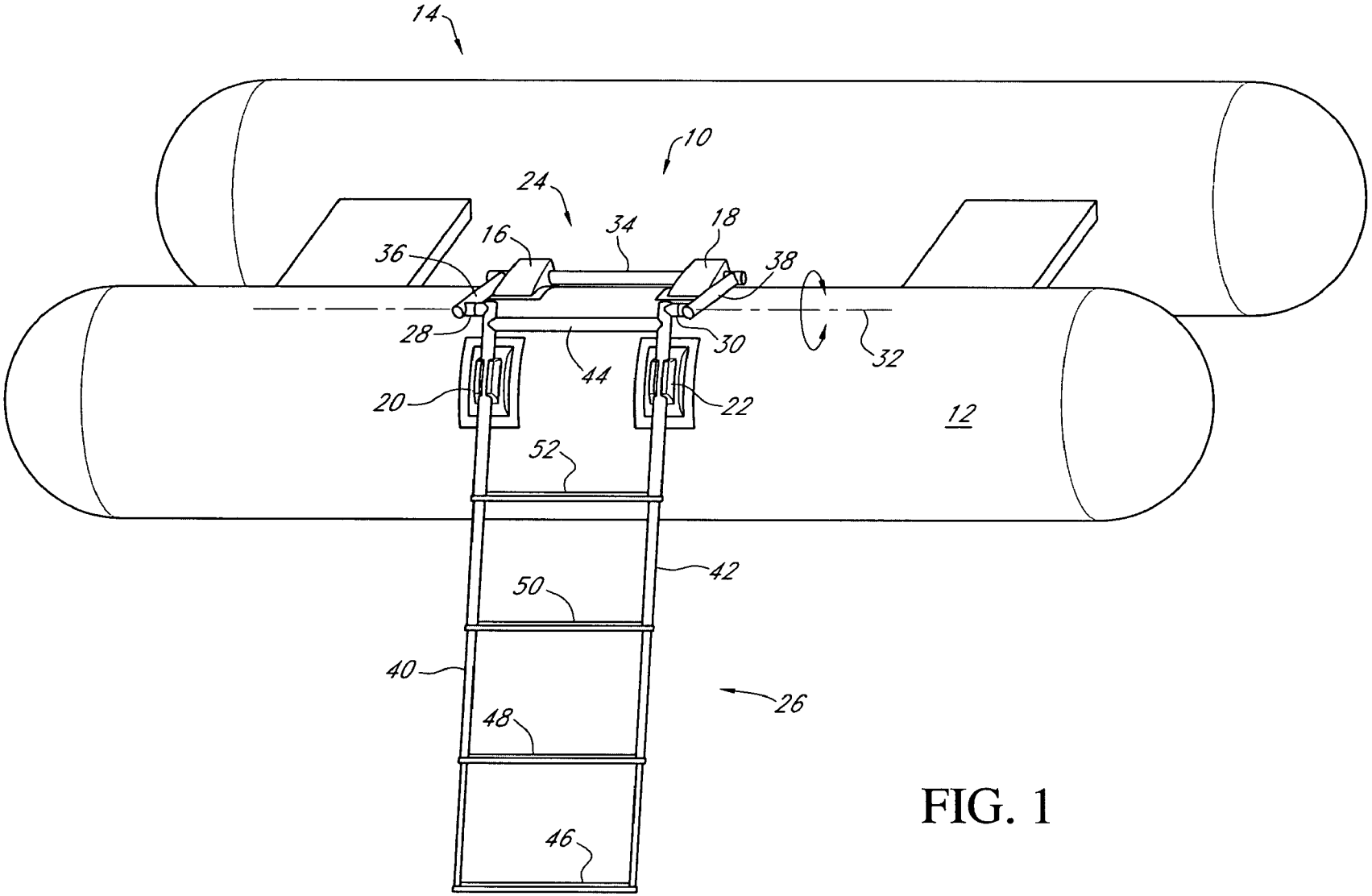
FIG. 1 is perspective view of a boarding ladder constructed according to a first embodiment of the present invention, shown attached in the operative boarding position on a pontoon of an inflatable boat.

In the description which follows, like parts are marked throughout the specification and drawing with the same reference numerals, respectively. The drawing figures are not necessarily drawn to scale.

Figure 5:
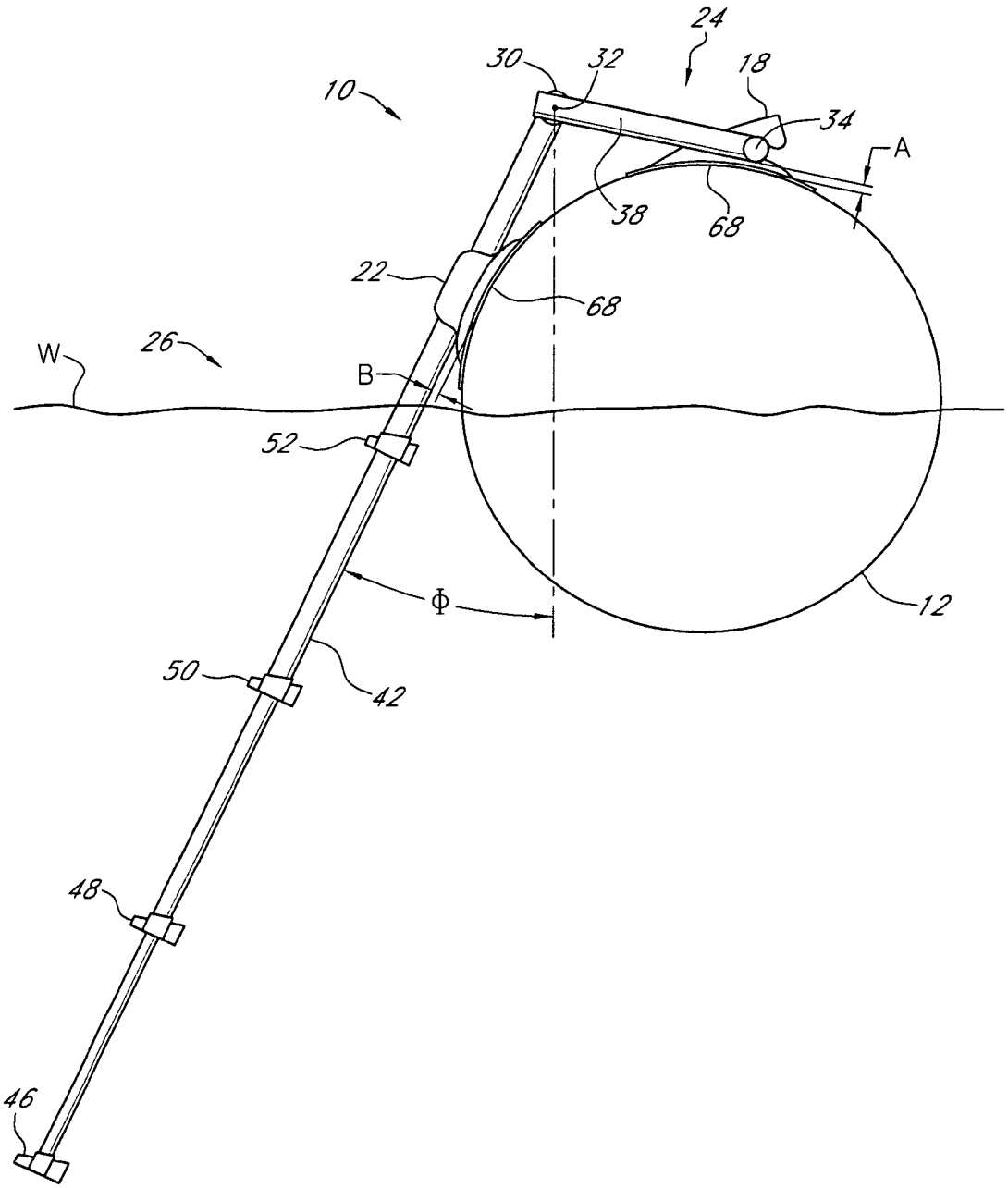
FIG. 5 is a side elevation view showing the boarding ladder of FIG. 1 attached in the operative boarding position onto the gunwale of an inflatable pontoon boat.

The boarding ladder assembly 10 of the present invention is attached to the pontoon 12 of an inflatable or rubberized boat 14 in an operative boarding position as shown in FIG. 1 and FIG. 5. The principal components of the boarding ladder assembly 10 include one or more base retainer brackets 16, 18 and one or more latch brackets 20, 22; a base ladder section 24; and a climbing ladder section 26. The base ladder section and the climbing ladder section are pivotally coupled together for opening movement relative to each other in which the sections are extended apart from each other to provide boarding service in an operative boarding position, and in closing movement relative to each other in which the sections are folded together for compact storage. The base retainer brackets 16, 18 provide hanging support for the base ladder section 24 in the operative boarding position. The latch brackets 20, 22 provide lateral and subjacent support for the climbing ladder section 26 and oppose side-to-side, lateral shifting movement of the climbing ladder section relative to the boat 14.

Figure 9:
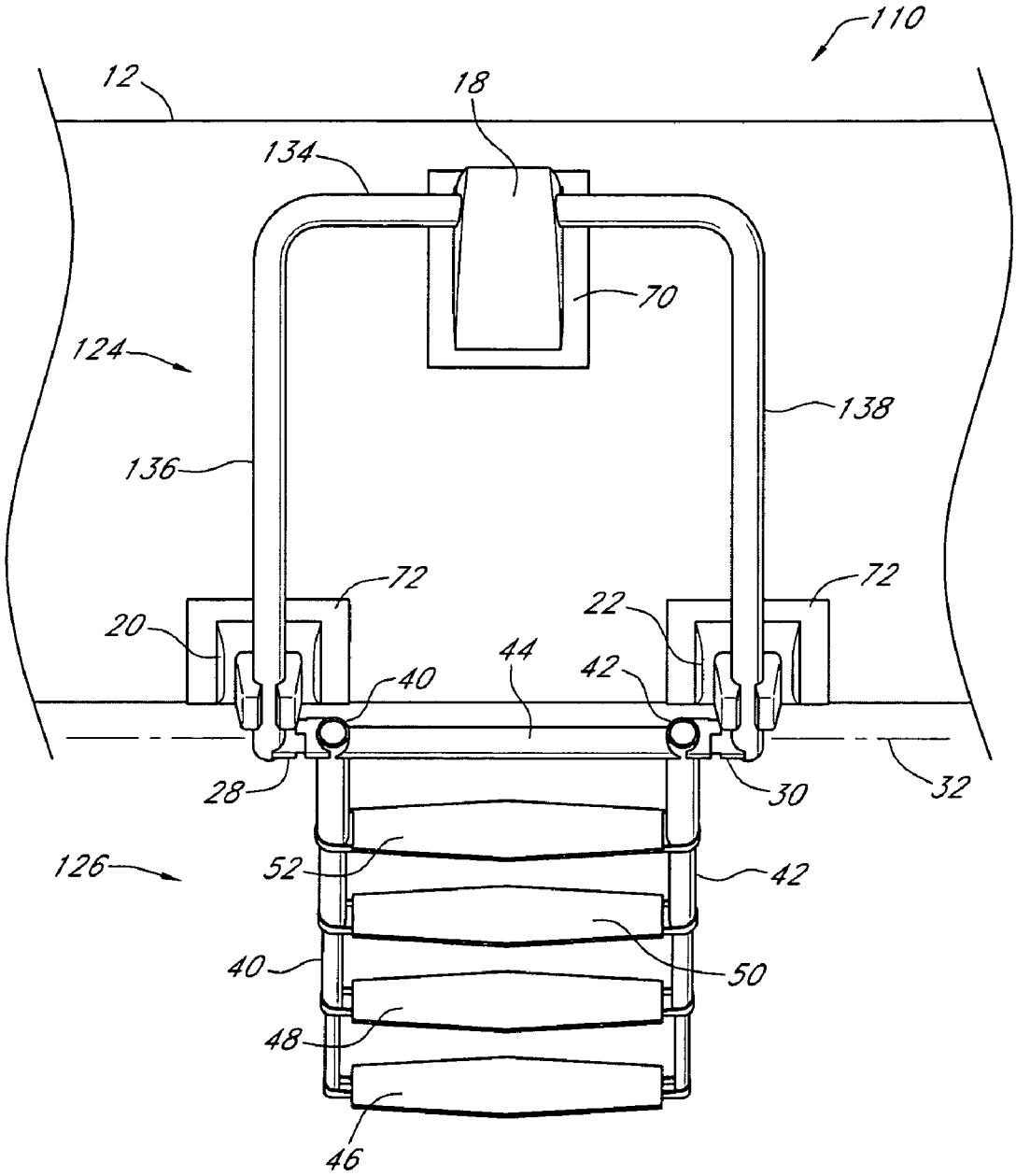
FIG. 9 is a top plan view thereof.

Referring to FIG. 5 and FIG. 9, the base retainer brackets 16, 18 engage the support ladder section 24 and maintain a separation spacing A between the base ladder section and the pontoon 12 in the operative boarding position. Likewise, the latch brackets 20, 24 engage the climbing ladder section 26 and maintain an offset spacing B between the climbing ladder section and the pontoon 12 when placed in the operative boarding position.

Figure 7:
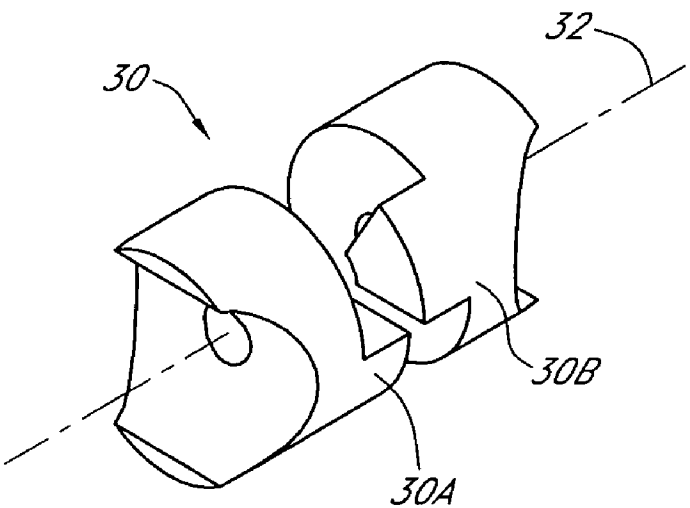
FIG. 7 is a perspective view of a right hinge assembly.
Figure 6:
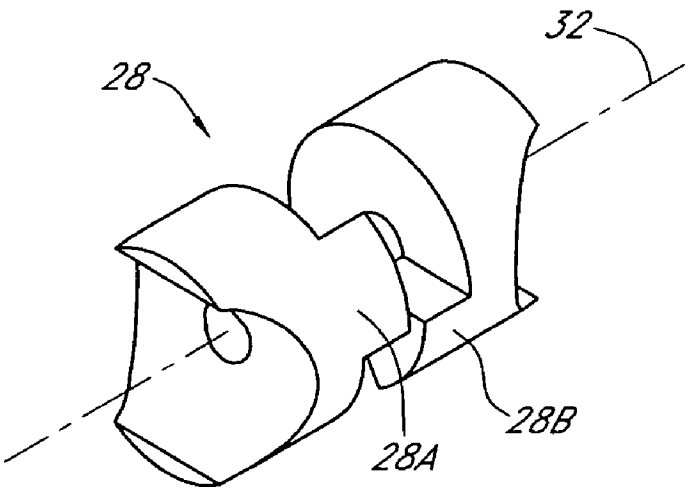
FIG. 6 is a perspective view of a left hinge assembly.

The base ladder section 24 and the climbing ladder section 26 are coupled together for opening and closing, pivotal movement relative to each other by coupling hinges 28, 30, shown in FIG. 6 and FIG. 7. The ladder sections are rotatable about a common axis 32 which extends through the coupling hinges. Preferably, the coupling hinges have cam portions 28A, 28B and 30A, 30B that engage and limit opening separation of the ladder sections, so that the climbing ladder section 26 hangs down at a predetermined slope angle $\Phi$ into the water W adjacent the pontoon side of the boat 12 in the operative boarding position. This arrangement provides a preferred ladder inclination angle, preferably about 15 degrees relative to vertical, when the ladder sections 24, 26 are installed in the operative boarding position as shown in FIG. 1 and FIG. 5.

This manual folding and unfolding arrangement allows the ladder sections 24, 26 to be closed together for storage, and then quickly set-up and installed for service in the operative boarding position. Optionally, the base ladder section 24 may be coupled to the climbing ladder section 26 by conventional double-knuckle hinges.

The base ladder section 24 is formed by a pair of tubular side rails 36, 38 that extend in parallel alignment from a tubular cross bar 34. The lower end portions of the side rails are attached, for example by welding, onto the cam-lock hinges 28, 30 (shown in FIG. 6 and FIG. 7). In the operative boarding position, the cross bar 34 is captured within hook pockets 16B, 18B formed in the base retainer brackets 16, 18, respectively, that provide hanging load support for the entire boarding ladder 10. The base retainer brackets 16, 18 also stabilize the upper end of the base ladder section 24 against outboard rotation and side-to-side shifting movement. As shown in FIG. 9, the external top surface portion 16A of each base retainer bracket is embossed in a crosscut pattern of ridges and grooves, thereby providing a slip-resistant step surface.

The climbing ladder section 26 is formed by a pair of tubular side rails 40, 42 that extend in parallel from a tubular cross bar 44. The lower end portions of the side rails are permanently attached to the cam-lock hinges 28, 30. The side rails 40, 44 are also joined in parallel alignment by a series of conventional steps 46, 48, 50 and 52. The steps are spaced apart along a 10-inch to 12-inch vertical rise between steps in a conventional staircase manner.

Each latch bracket 20, 22 is provided with an elongated latch pocket 54 and a pair of resilient latch arms 56, 58. The tubular side rails 40, 42 of the climbing ladder section 26 are releasably retained in the latch pockets by the gripping engagement of the resilient latch arms. The latch arms 56, 58 oppose lateral shifting and swinging movement of the climbing ladder section 26 relative to the pontoon 12. According to this arrangement, the base ladder section 24 hangs from and is stabilized by the base retainer brackets 16, 18. The climbing ladder section 26 hangs from the cam-lock hinges 28, 30 and is stabilized by the gripping engagement of the latch brackets 20, 22. The side rails 40, 42 are further stabilized by a welded union with the cross bar 44 on the upper end of the climbing ladder section 26.

Figure 3:
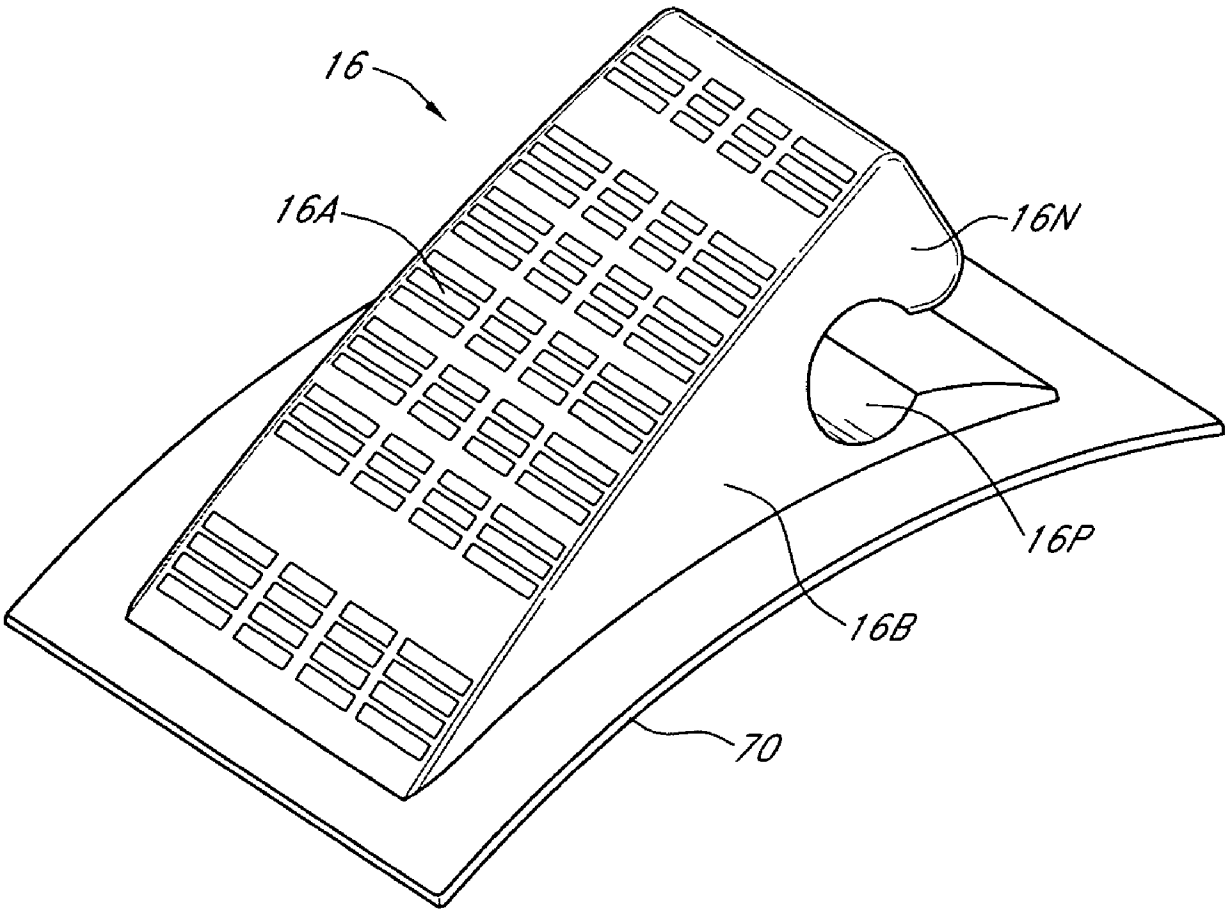
FIG. 3 is a perspective view of a hook embodiment of a base retainer bracket.
Figure 4:
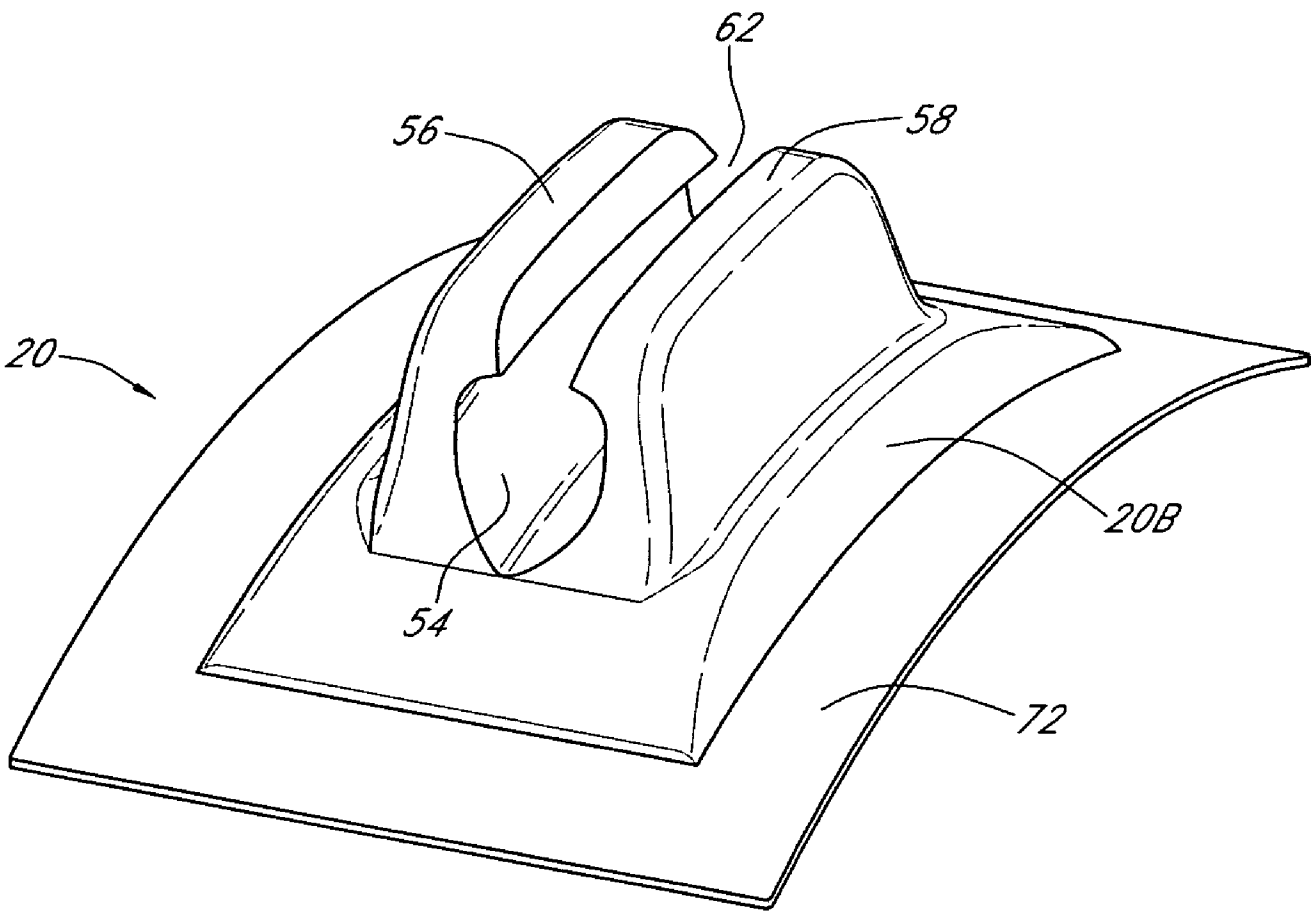
FIG. 4 is a perspective view of a latch retainer bracket.

According to an important feature of the invention, the boarding ladder can be manually released and quickly removed from the support brackets. This is made possible by the open hook, snap-fit construction of the base retainer brackets 16, 18, shown in FIG. 3, and the open latch, snap-fit construction of the latch brackets 20, 22, shown in FIG. 4. The open hook pockets 16B, 18B are dimensioned to capture and retain the tubular cross bar 34 of the base ladder section 24. The insertion opening of each hook pocket is delimited by a resilient nub portion 16N of the hook, which yields and deflects to allow insertion and gripping capture of the tubular cross bar 34. The cross bar may be manually released and withdrawn by applying a straight inboard pull against the base ladder section, as indicated by the arrow 60 in FIG. 2.

Referring again to FIG. 2 and FIG. 4, the latch brackets 18, 20 each include a manually releasable coupling member for engaging and retaining the climbing ladder section in the operative boarding position. In the preferred embodiment, the manually releasable coupling member is provided by the elongated, resilient latch 20 shown in FIG. 4. The latch 20 has a latching pocket 54 that opens along an elongated entrance slot 62. The entrance slot 62 is delimited by resilient gripping arms 56, 58 that yield and deflect to allow insertion and capture of the ladder side rail tubing segments. The ladder side rail tubing segments may be manually released and removed from latched engagement by rotating the climbing ladder section 26 inboard and away from the latch brackets, as indicated by the arrows 64, 66 in FIG. 2.

Figure 2:
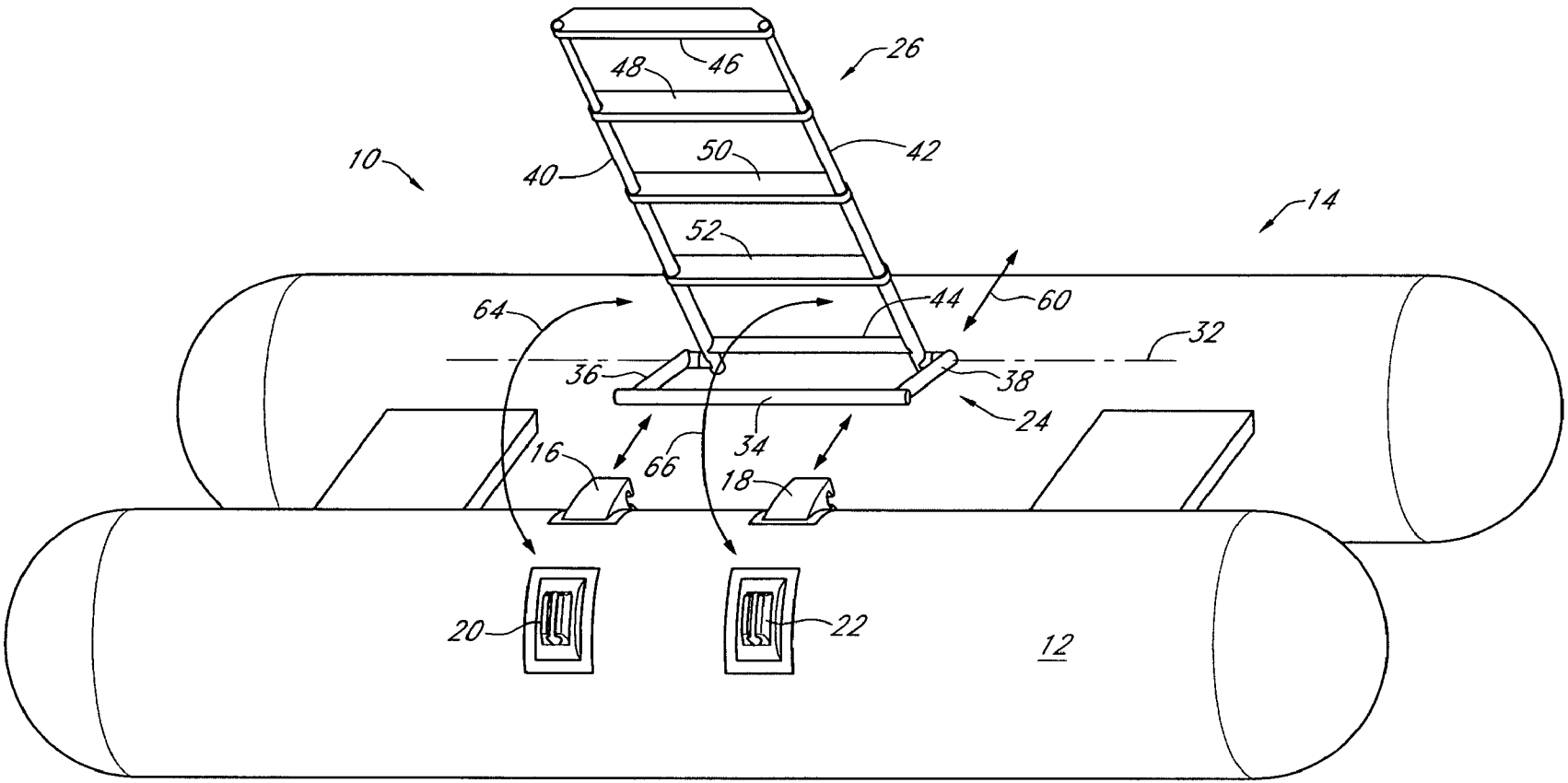
FIG. 2 is a view similar to FIG. 1 showing the boarding ladder aligned with mounting brackets during installation in the operative boarding position.

Referring again to FIG. 1, the boarding ladder 10 is attached to an inflatable or rubberized boat 14, for example a pontoon boat, dinghy, life raft, runabout or similar small watercraft, for use by divers and swimmers, and in emergency man-overboard rescue situations, in boarding from open water W. The boarding ladder 10 is shown attached to the pontoon 12 of the boat 14, using one or more base retainer brackets 16, 18 and a pair of latching brackets 20, 22. The hook retainer brackets and latching brackets are attached to the pontoon by an adhesive deposit 68 as shown in FIG. 5. As can be seen in FIG. 2, the support brackets 16, 18 and 20, 22 are attached to external surface portions of the pontoon 12 at vertically and laterally spaced locations along the curved sidewall. The boarding ladder 10 can be swung up and out of the water 14 and quickly removed from the support brackets for storage when not in use.

Although the boarding ladder 10 may be made of a variety of materials, in the preferred embodiment the material used to fabricate the side rails and cross bars is metal tubing, preferably a non-corrosive metal, such as 14-gage stainless steel tubing, or composite, high strength tubing. Optionally, the ladder components can be constructed of solid aluminum rods, stainless steel rods and composite, high strength engineered materials. The retainer pockets 16B, 18B formed in the hook brackets are dimensioned to provide positive, snap fit engagement with the upper cross bar 34. Likewise, the retainer pockets formed in the latch brackets 20, 22 are dimensioned to provide positive, snap fit engagement with the tubular side rail sections 40, 42. The steps 46, 48, 50 and 52 are made of formed stainless steel and are encased within a plastic cover. Non-slip treads are formed on the top surface of each cover.

The base retainer brackets 15, 18 and the latch brackets 20, 22 are made of a resilient polymer material and are bonded to the pontoon 12 by adhesive deposits 68. The brackets are resilient and somewhat yieldable in order to reduce the concentration of load forces applied to the pontoon during boarding and unloading. The brackets 16, 18 and 20, 22 have resilient shock absorbing body portions 16B, 18B and 20B, 22B that dissipate the energy of high intensity loading forces. The resilient body portions and gripping arm portions further decouple the loading forces and thereby reduce the concentration of loading forces that are applied to the pontoon.

Referring now to FIG. 1, FIG. 2, FIG. 3 and FIG. 4, the base retainer brackets 16, 18 and latch brackets 20, 22 include marginal flange portions 70 and 72, respectively, which extend laterally along the perimeter of the support brackets. Preferably, the flange portions are integrally formed with the resilient body portions of each bracket. The flange portions 70 and 72 are attached to the pontoon at selected external surface locations on the pontoon 12 and thereby increase the overall bonding interface area. The increased bonding area reduces the concentration of load forces and increases the bond strength of the adhesive union between each support bracket and the sidewall of the pontoon hull.

The resilient body portions 16B, 20B of each base retainer bracket transition from a relatively small coupling member, either the hook (the upper brackets 16, 18) or the U-shaped latches (lower brackets 20, 22), into a large bonding surface area provided by the flange portions 70, 72. The bonding surface area is rectangular in profile and spreads the load forces substantially uniformly over the bonding surface of the pontoon 12. Otherwise, those forces would be concentrated at high intensity attachment points if the ladder side rails were permitted to engage directly onto the pontoon sidewall, for example with a piercing fastener.

The shock absorbing portions of the resilient retainer brackets 16, 18 and latch brackets 20, 22 reduce the per unit loading of the applied boarding load forces, and spread those load forces uniformly across widely separated and relatively large surface areas of the pontoon 12. Moreover, the body portions of the base retainer brackets and latch brackets are flexible and yieldable. This permits manual insertion and detachment of the ladder side rails and the tubing cross bar into and out of engagement with the support brackets during setup and removal of the boarding ladder. Otherwise, if a rigid construction were to be used instead, the brackets would not yield or deflect, and the entire energy of the applied load forces would be focused and concentrated at point loading locations on the pontoon. Such concentrated forces could exceed the shear strength of the adhesive bond 68 and cause separation of the brackets 16, 18 and 20, 22 from the pontoon, or cause fatigue failure and rupture of the pontoon sidewall at the attachment points.

The strongest and most reliable bond is achieved when the polymer material used for fabricating the hook and latch brackets 16, 18 and 20, 22 is coordinated with the polymer material used to make the pontoon hull. Conventional rubber inflatable boats have pontoons that are made of Hypalon® chlorosulfonated polyethylene, polyurethane or polyvinyl chloride (PVC) polymer materials. The hook and latch brackets are fabricated of polyvinyl chloride in a conventional injection molding process when they are to be attached to pontoons made of polyvinyl chloride, and they are fabricated of ethylene propylene diene monomer elastomer (EPDM) when they are to be attached to a pontoon constructed of Hypalon® chlorosulfonated polyethylene or polyurethane materials. The preferred bonding adhesive 68 is Poly Marine 2990 adhesive for bonding the brackets onto pontoons made of Hypalon® chlorosulfonated polyethylene; Poly Marine 3026 PVC fabric adhesive is preferred for bonding the brackets onto pontoons made of polyvinylchloride (PVC).

Figure 8:
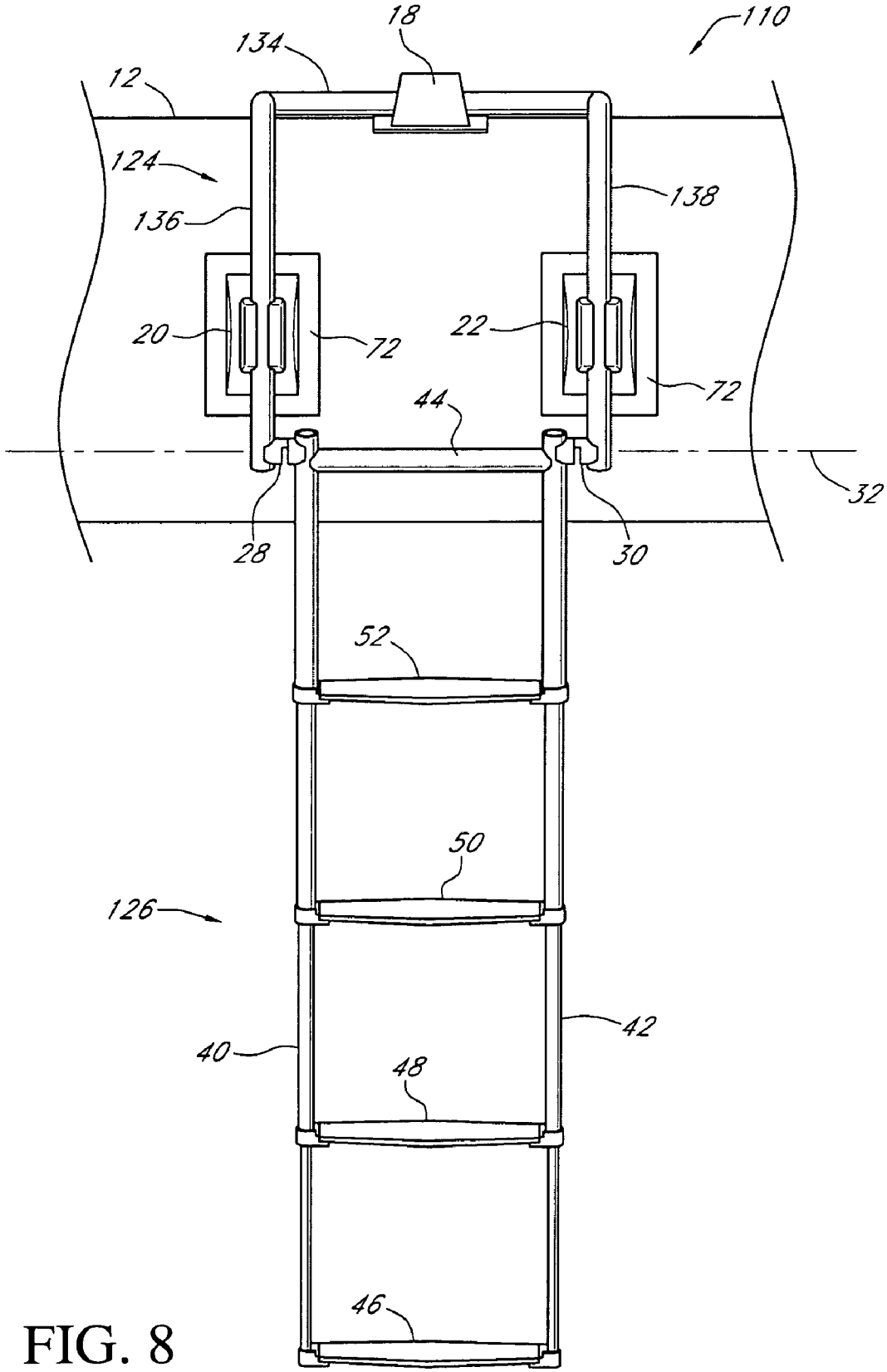
FIG. 8 is a front elevation view of a boarding ladder assembly constructed according to an alternative embodiment of my invention, shown installed in the operative boarding position onto the side of a pontoon boat.
Figure 10:
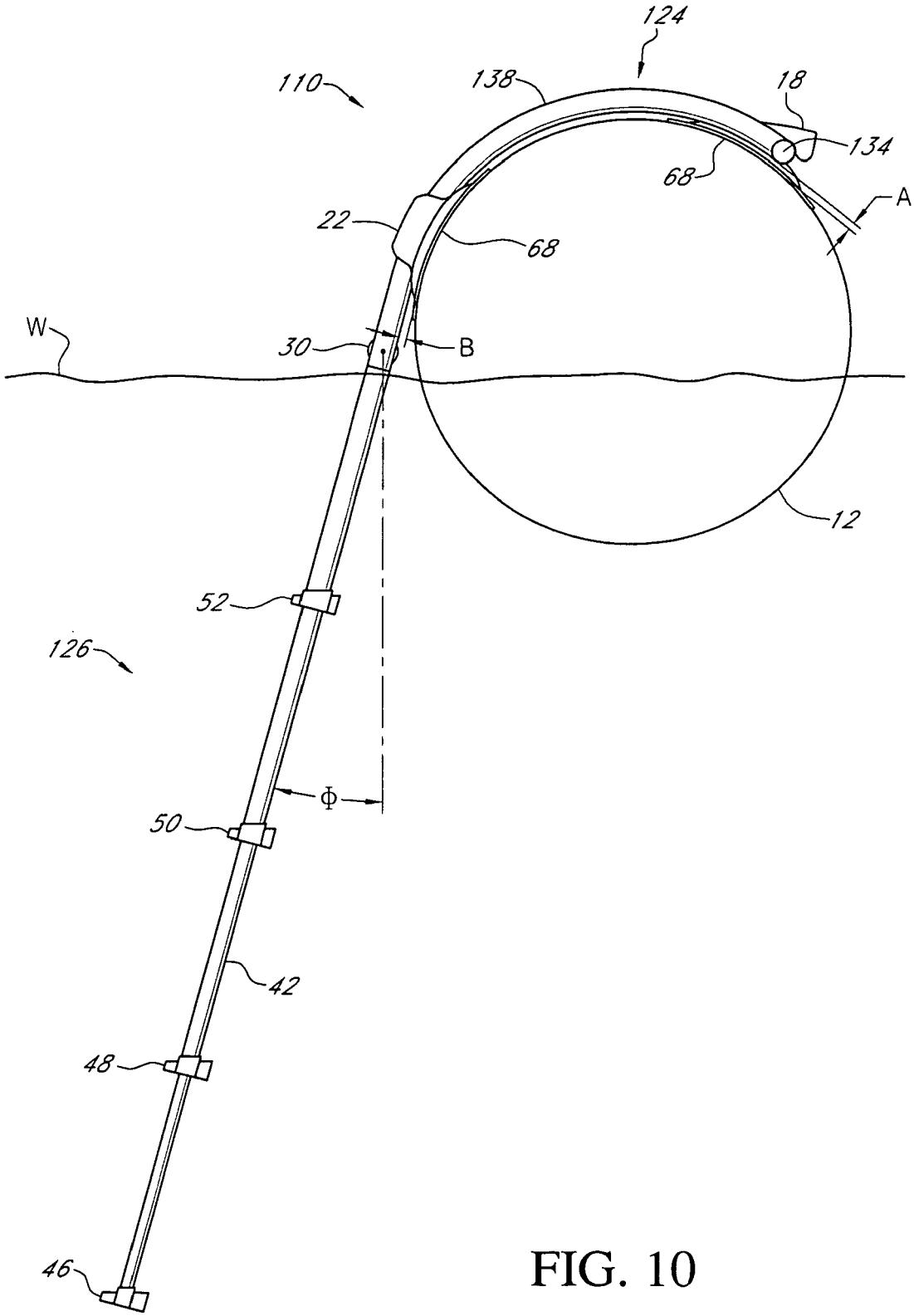
FIG. 10 is a right side elevation view thereof.

A boarding ladder assembly 110 according to an alternative embodiment is shown in FIG. 8, FIG. 9 and FIG. 10. The boarding ladder 110 includes a curved base ladder section 124 and a straight climbing ladder section 126. In this embodiment, a single base retainer bracket 18 provides hanging support for the boarding ladder, and the side rail portions 136, 138 of the base ladder section 124 are curved to conform in profile with the curvature of the underlying pontoon 12. The boarding ladder assembly 110 is otherwise identical in construction and operation to the boarding ladder 10 in all respects. The climbing ladder section 126 is stabilized against shifting movement by a pair of latch brackets 20, 22 as previously described in connection with the boarding ladder 10.

Figure 11:
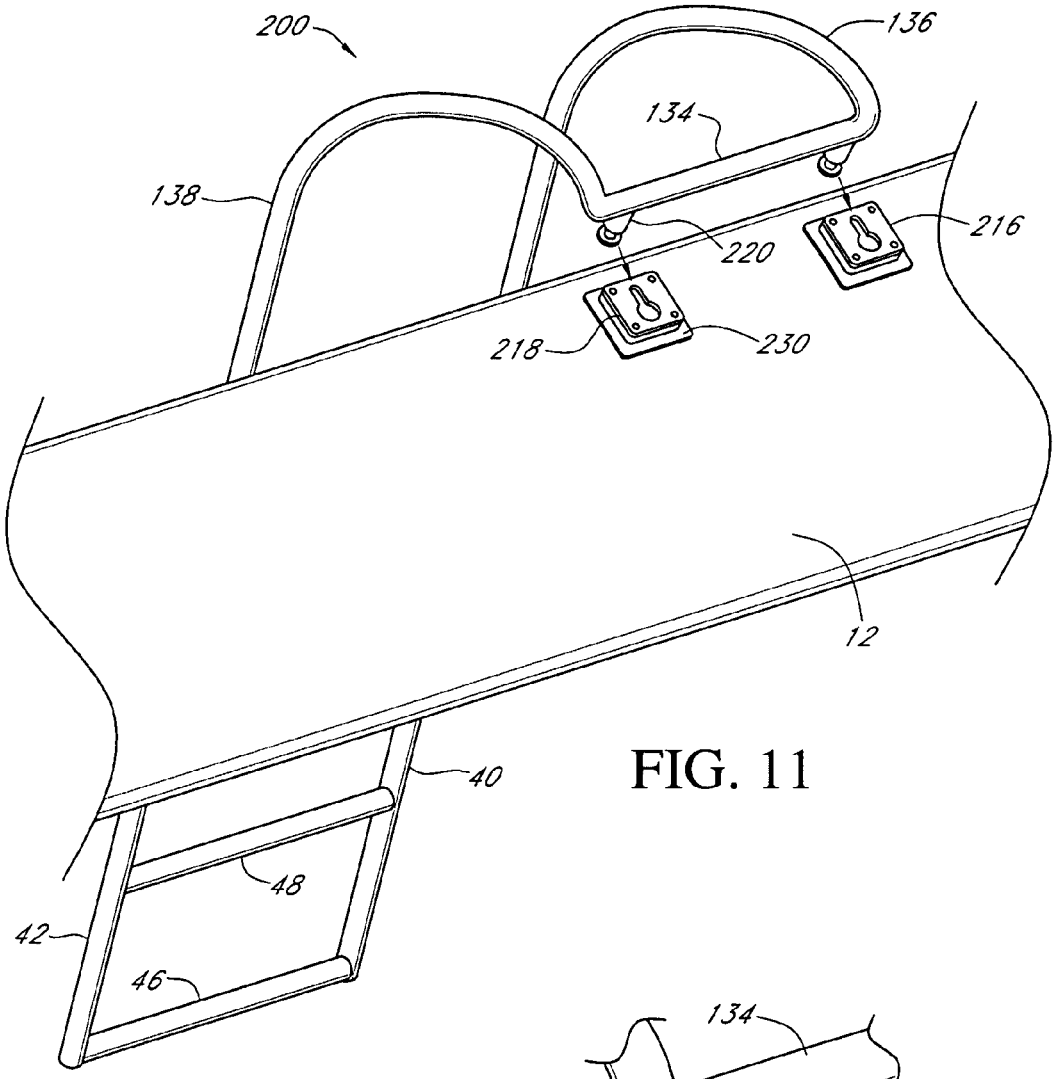
FIG. 11 is perspective view of a boarding ladder constructed according to an alternative embodiment, showing the boarding ladder aligned for installation on hard-point base retainer brackets.
Figure 12:
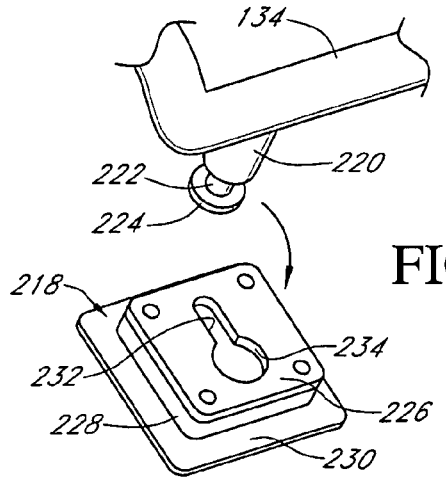
FIG. 12 is an exploded perspective detail view of a locking pin and a hard-point base retainer bracket.
Figure 13:
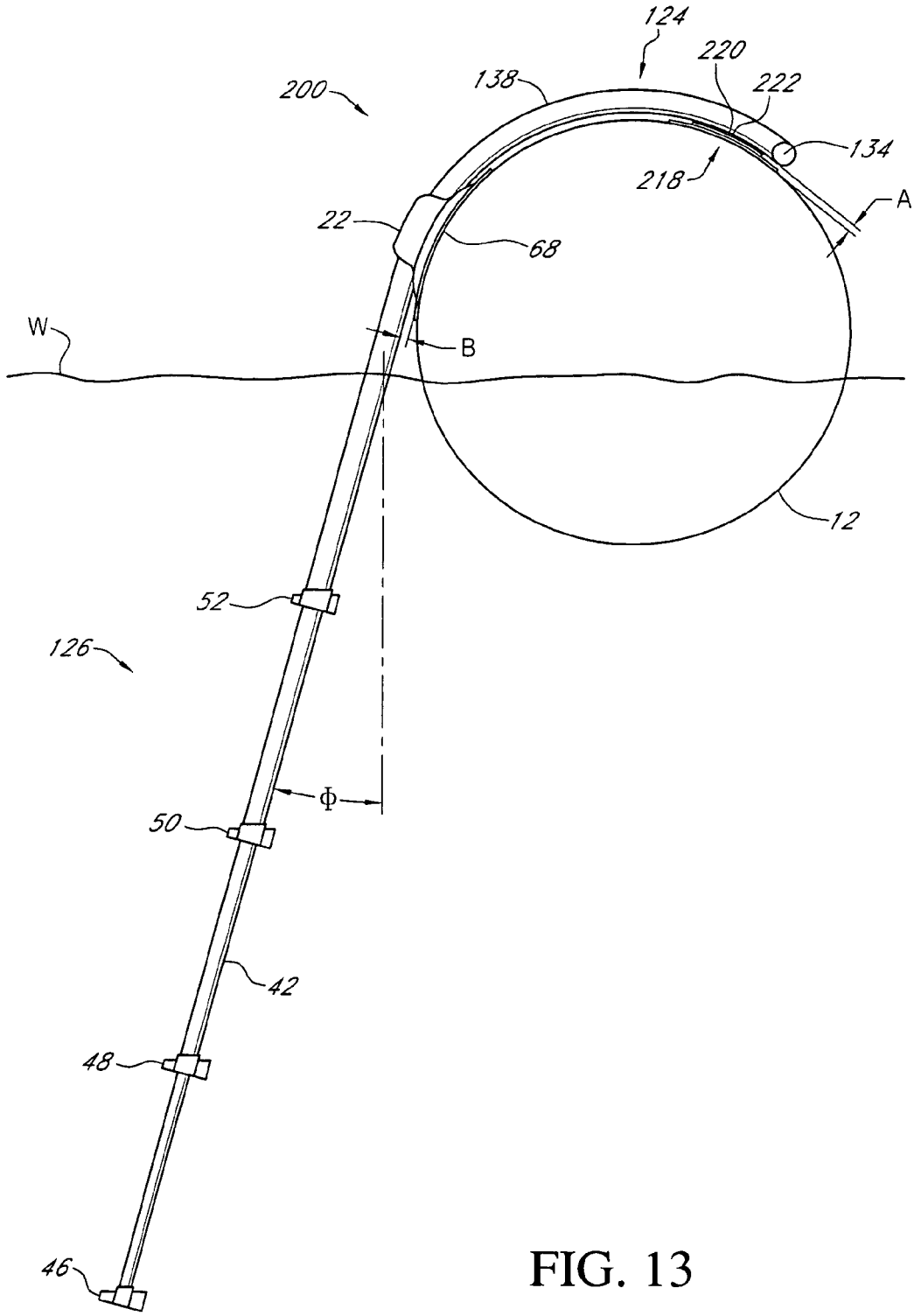
FIG. 13 is right side elevation view of the boarding ladder of FIG. 11.
Figure 14:
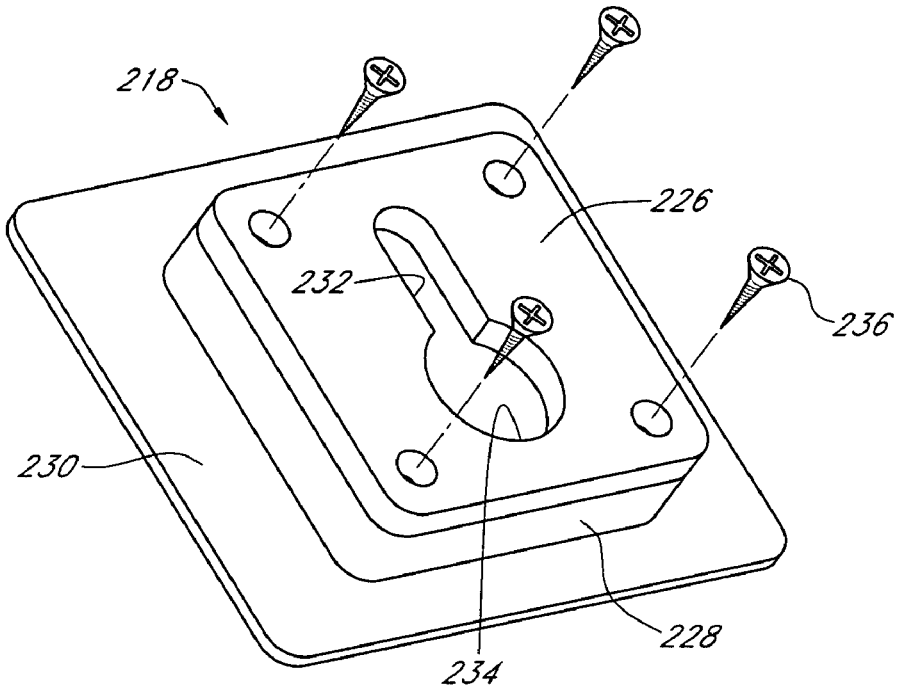
FIG. 14 is a perspective view of the hard-point base retainer bracket of FIG. 12.
Figure 15:
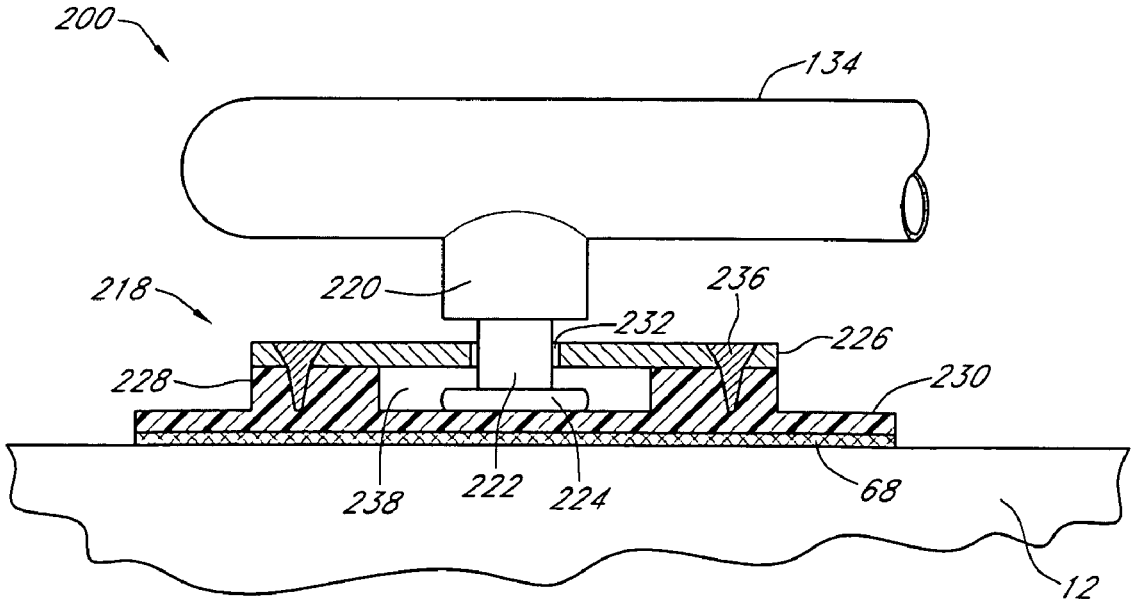
FIG. 15 is an elevation view, partly in section, showing engagement of a retainer pin in the keyhole slot of the hard-point base retainer bracket of FIG. 12 with the boarding ladder installed in the operative boarding position.
Figure 16:
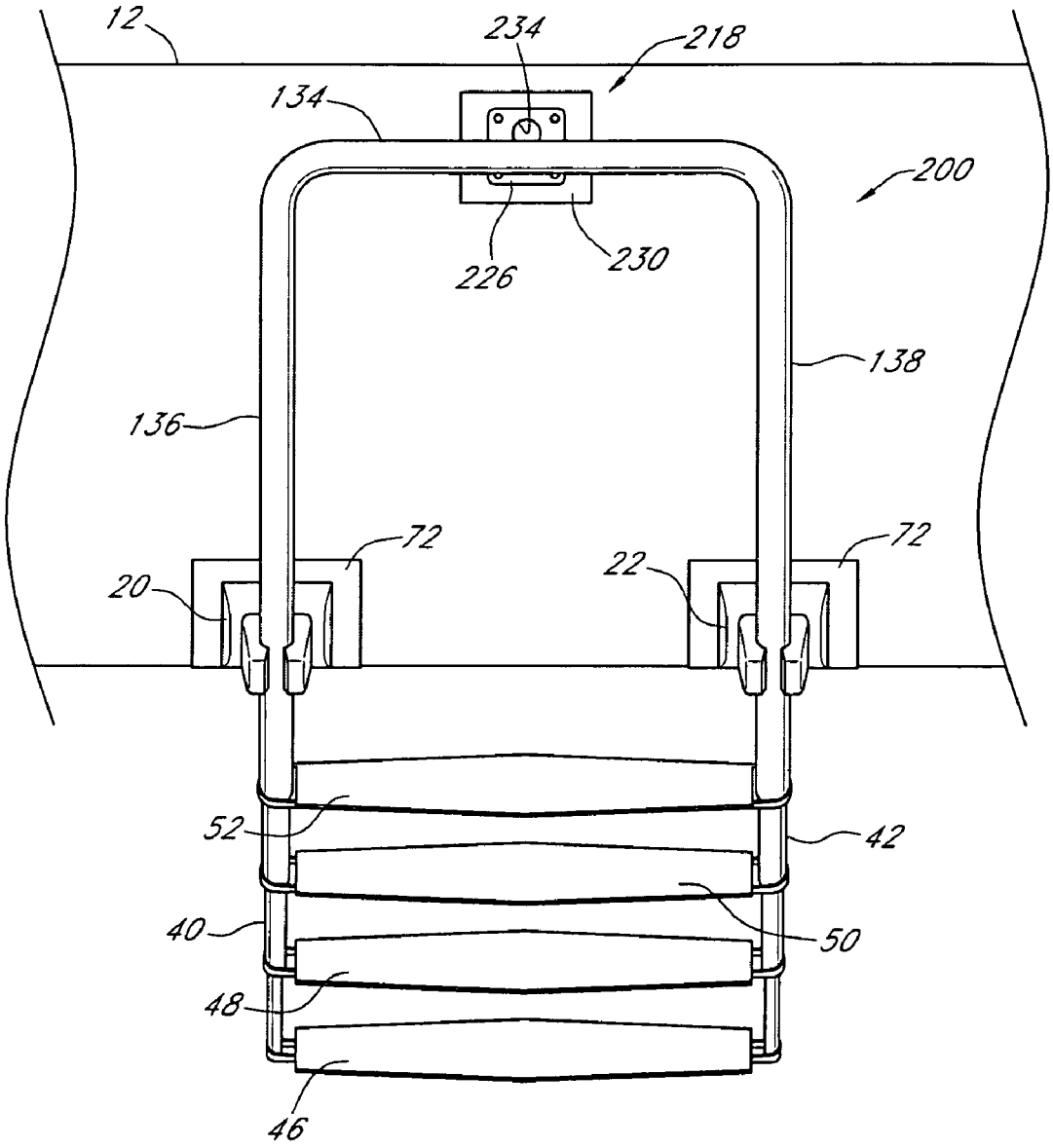
FIG. 16 is a top plan view of the boarding ladder of FIG. 13 supported in the operative boarding position by a single hard-point base retainer bracket.

A boarding ladder 200 according to yet another embodiment is shown in FIG. 11, FIG. 13 and FIG. 16. The boarding ladder 200 includes a curved base ladder section 124 rigidly attached to a straight climbing ladder section 126. The side rail portions 136, 138 of the base ladder section 124 are curved to conform in profile with the curvature of the underlying pontoon 12. In this embodiment, the boarding ladder 200 is supported by one or more hard-point base retainer brackets 216, 218, as shown in FIG. 12, FIG. 14 and FIG. 15. The hard-point base retainer brackets 216, 218 provide hanging support for the boarding ladder 200 in a dual base bracket configuration shown in FIG. 11, and in a single base bracket configuration shown in FIG. 16.

Referring again to FIG. 12, FIG. 14 and FIG. 15, the hard-point base retainer brackets 216, 218 have identical construction. One or more anchor stubs 220 are welded onto the underside of the cross bar 134. Each anchor stub includes an anchor pin 222 and a lock head 224 for insertion into interlocking engagement with the hard-point base retainer bracket. For this purpose, each bracket includes a hard-point mounting plate 226, constructed of stainless steel, that is fastened onto a base member 228 made of a moldable, resilient rubber material. The footprint of the base member 228 is enlarged by an integrally formed, resilient flap 230. The mounting plate 226 is intersected by a keyhole slot for receiving the anchor pin 222. The keyhole slot has a large diameter entrance aperture 234 that provides insertion clearance for the lock head 224. The entrance aperture 234 opens into a relatively narrow slot 234 that provides insertion clearance for the anchor pin 222, but prevents withdrawal of the latch head 224 in the fully inserted position shown in FIG. 15.

The hard-point retainer plate 226 is fastened onto the base member 228 by screw fasteners 236. A coupling pocket 238 is formed between the base portion and the retainer plate. The anchor pin 222 and lock head 224 are received in the coupling pocket 238 in the fully inserted, engaged position, as shown in FIG. 15. The hang load imposed on the ladder is reacted through the hard-point retainer plate 226. The resilient base member 228 and the resilient flap portion 230 dissipate the energy of high intensity loading forces and reduce the concentration of load forces applied to the pontoon during boarding.

Figure 19:
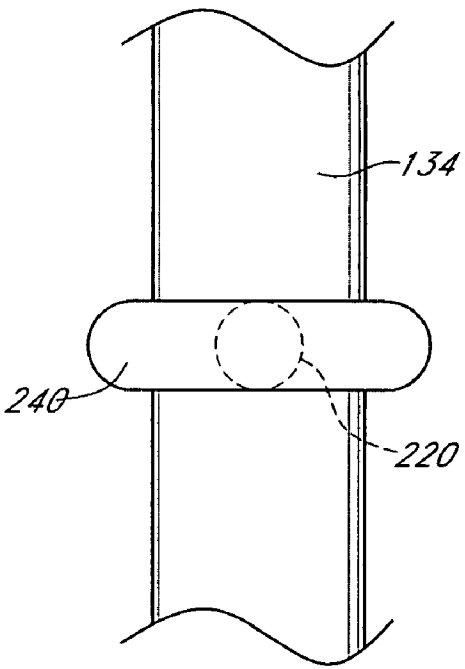
FIG. 19 is a bottom plan view thereof.
Figure 18:
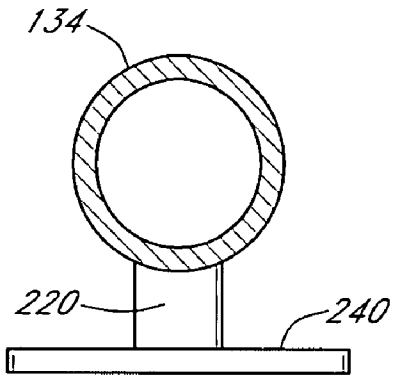
FIG. 18 is a sectional view thereof, taken along the line 18-18 of FIG. 17.
Figure 17:
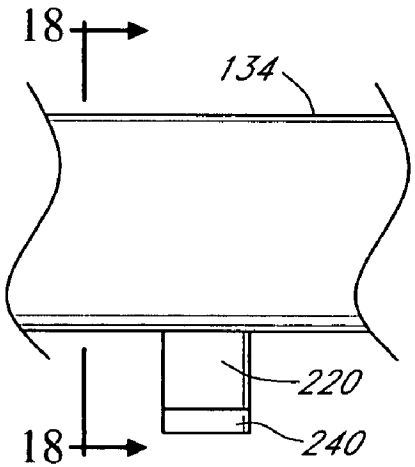
FIG. 17 is a side elevation view of a retainer pin assembly that is equipped with a latch arm.

Referring now to FIG. 17, FIG. 18 and FIG. 19, a hard-point base retainer bracket 242 is configured with a positive cam lock 252. An anchor stub 220 is welded onto the underside of the cross bar 134. A lock bar 240 is attached to the anchor stub for insertion into interlocking engagement with the base retainer bracket 242. For this purpose, the retainer bracket 242 includes a hard-point mounting plate 246, constructed of stainless steel, that is fastened onto a base member 244 made of a moldable, resilient rubber material. The mounting plate 246 is intersected by an elongated slot 248 for receiving the lock bar 240. The hard-point retainer plate 246 is fastened onto the base member 244 by screw fasteners 236. A coupling pocket 258 is formed in the base member directly beneath the hard-point retainer plate 246. Preferably, the coupling pocket 258 is bounded by a circular sidewall 250 formed in the base member 244, and is dimensioned to accommodate free rotation of a rotor disc 256 (FIG. 22) within the coupling pocket 258.

Figure 21:
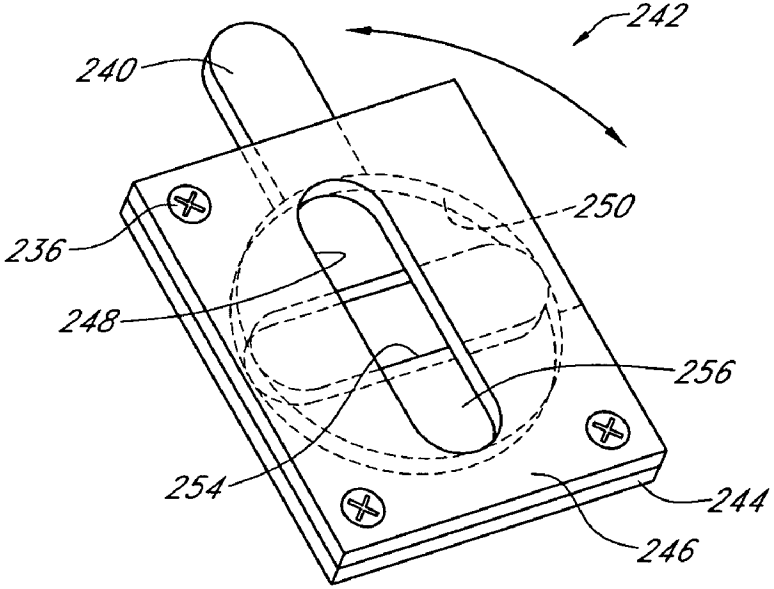
FIG. 21 is a perspective view of the hard-point base retainer bracket of FIG. 20, with the cam lock shown rotated to the locked position.
Figure 20:
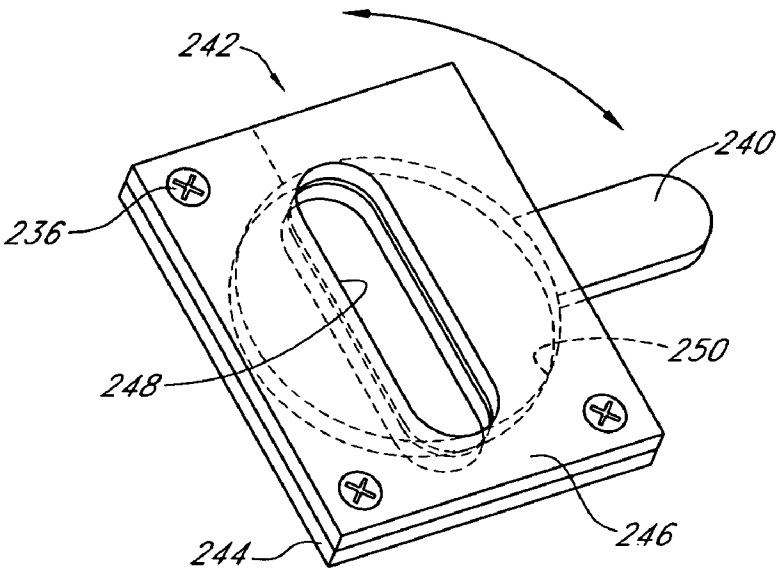
FIG. 20 is a perspective view of a hard-point base retainer bracket that is equipped with a rotatable cam lock, with the cam lock shown in the open position for receiving the latch arm of the retainer pin assembly of FIG. 17.
Figure 22:
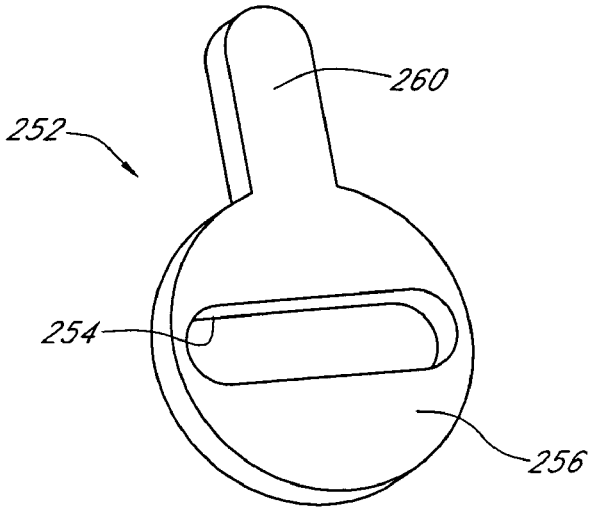
FIG. 22 is a perspective view of the rotatable cam lock.
Figure 23:
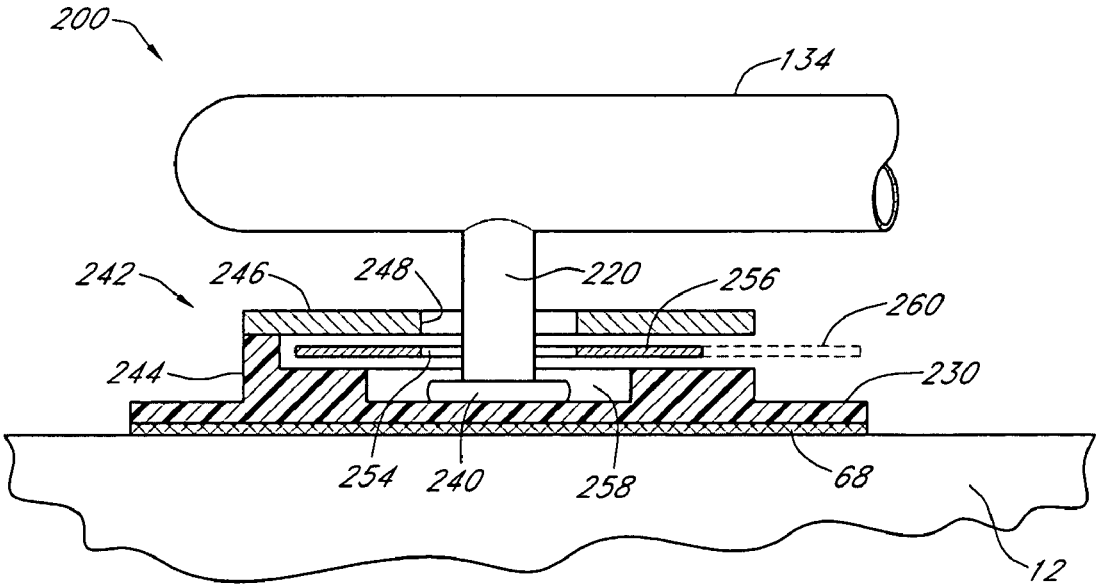
FIG. 23 is an elevation view, partly in section, of the hard-point base retainer bracket of FIG. 20, in which the retainer pin assembly of FIG. 17 is captured in locked engagement by the rotatable cam lock of FIG. 22.

As shown in FIG. 22, the disc body 256 of the rotor 252 is intersected by an aperture 254 that is dimensioned to accommodate insertion of the lock bar 240. Referring to FIG. 23, the lock bar 240 is inserted through the retainer plate slot 248, the rotor slot 254 and into the coupling pocket 258, lying beneath the rotor disc body 256. The rotor 252 includes an actuator arm 260 that projects out of the base retainer bracket, so that it can be manually shifted from an open position (FIG. 20), in which the insertion apertures 248, 254 are aligned, allowing full insertion of the lock bar 240 into the coupling pocket 258, to a locked position (FIG. 21) in which the lock bar 242 is captured by the rotor body 256 and retained in the operative support position. The phantom profile 260 in FIG. 23 indicates the position of the actuator arm in the released (open) position.

The invention has been shown and described with reference to preferred and alternative embodiments in which examples have been given to explain what I believe is the best way to make and use my boarding ladder invention. The materials, components and dimensional values specified in the detailed description are exemplary of those that may be used in the successful practice of my invention.

I claim:

1. A boarding ladder assembly for attachment to a boat in an operative boarding position, comprising in combination:

a base ladder section;

a climbing ladder section coupled to the base ladder section;

a first support bracket adapted for installation at a first attachment location on a boat, the first support bracket including portions for releasably engaging the base ladder section and providing hanging support thereto in the operative boarding position; and a second support bracket adapted for attachment at a second attachment location on a boat, the second support bracket including portions for releasably engaging the climbing ladder section and opposing shifting movement thereof in the operative boarding position, wherein the second support bracket includes gripping portions forming a latch.

2. A boarding ladder assembly as set forth in claim 1, wherein the first support bracket comprises portions forming a retainer hook.

3. A boarding ladder assembly as set forth in claim 1, wherein the base ladder section and the climbing ladder section are coupled together for extension and retraction movement relative to each other.

4. A boarding ladder assembly as set forth in claim 1, wherein the base ladder section and the climbing ladder section are coupled together for pivotal movement relative to each other.

5. A boarding ladder assembly as set forth in claim 1, wherein the base ladder section and the climbing ladder section are rigidly attached together.

6. A boarding ladder assembly as set forth in claim 1, wherein the first support bracket comprises a first hook member and a second hook member that are laterally spaced apart relative to each other in the operative boarding position.

7. A boarding ladder assembly as set forth in claim 1, wherein the first support bracket comprises a hook made of a moldable polymer material.

8. A boarding ladder assembly as set forth in claim 1, wherein the first support bracket comprises:

a base member having a pocket for receiving a retainer pin; and a retainer plate attached to the base member and overlapping the pocket, the retainer plate being intersected by a keyhole slot for receiving and engaging a retainer pin in the pocket.

9. A boarding ladder assembly for attachment to a boat in an operative boarding position, comprising in combination:

a base ladder section;

a climbing ladder section movably coupled to the base ladder section;

a first support bracket including a base member having a pocket for receiving a lock bar and a retainer plate attached to the base member and overlapping the pocket, the retainer plate being intersected by a slot for admitting a lock bar into the pocket, the first support bracket adapted for attachment to a boat at a first attachment location, the first support bracket including a manually releasable coupling for retaining the base ladder section in the operative boarding position;

a second support bracket adapted for attachment to a boat at a second attachment position, the second support bracket including a manually releasable coupling for retaining the climbing ladder section in the operative boarding position.

10. A boarding ladder assembly as set forth in claim 9, wherein the first support bracket comprises:

a base member having a pocket for receiving a lock bar; and a retainer plate attached to the base member and overlapping the pocket, the retainer plate being intersected by an insertion aperture for admitting a lock bar into the coupling pocket; and a rotor disposed for rotation within the coupling pocket, the rotor being intersected by an insertion aperture for allowing passage of a lock bar through the coupling pocket, and the rotor is manually movable from a first position in which the insertion apertures are aligned to admit full insertion of a lock bar into the coupling pocket, and movable to a second position in which the rotor at least partially overlaps the insertion aperture of the retainer plate, thereby opposing withdrawal of the lock bar out of the coupling pocket.

11. A boarding ladder assembly for attachment to a boat in an operative boarding position, comprising in combination:

a base ladder section;

a climbing ladder section movably coupled to the base ladder section;

a first support bracket adapted for attachment to a boat at a first attachment location, the first support bracket including a hook member made of a resilient polymer material for providing hanging support for the base ladder section in the operative boarding position; and a second support bracket adapted for attachment to a boat at a second attachment position, the second support bracket including a latch member made of a resilient polymer material for opposing shifting movement of the climbing ladder section relative to the boat in the operative boarding position.

12. A boarding ladder assembly as set forth in claim 11, wherein the hook member and the latch member are fabricated of polyvinyl chloride polymer material.

13. A boarding ladder assembly as set forth in claim 11, wherein the hook member and the latch member are fabricated of ethylene propylene diene monomer elastomer material.

14. A boarding ladder assembly according to claim 11, wherein the hook member has a bonding surface portion and a shock absorbing body portion that extends from the hook member to the bonding surface portion.

15. A boarding ladder assembly according to claim 11, wherein the latch member includes a bonding surface portion and a shock absorbing body portion that extends from the latch to the bonding surface portion.

16. A boarding ladder assembly according to claim 11, wherein each hook member has a retainer pocket and a resilient nub portion that delimits the retainer pocket, and the resilient nub portion is yieldably deflectable to permit manual insertion and removal of a ladder cross bar into and out of the retainer pocket.

17. A boarding ladder assembly according to claim 11, wherein each latch member comprises:

a base member and a retainer pocket formed in the base member for receiving a ladder crossbar; and first and second resilient arm portions attached to the base member for gripping engagement with a ladder crossbar disposed in the retainer pocket.

18. A boarding ladder assembly for attachment to a boat in an operative boarding position, comprising in combination:

a base ladder section;

a climbing ladder section movably coupled to the base ladder section;

a first support bracket adapted for attachment to a boat at a first attachment location, the first support bracket including a hook member providing hanging support for the base ladder section in the operative boarding position; and a second support bracket adapted for attachment to a boat at a second attachment location, the second support bracket including a latch member made of a resilient polymer material for yieldably opposing shifting movement of the climbing ladder section relative to the boat in the operative boarding position.

19. A boarding ladder assembly for attachment to a boat in an operative boarding position, comprising in combination:

a base ladder section;

a climbing ladder section coupled to the base ladder section;

a first support bracket adapted for installation at a first attachment location on a boat, the first support bracket including portions for releasably engaging the base ladder section and providing hanging support thereto in the operative boarding position; and a second support bracket adapted for attachment at a second attachment location on a boat, the second support bracket including portions for releasably engaging the climbing ladder section and opposing shifting movement thereof in the operative boarding position, wherein the second support bracket includes a first latch member and a second latch member that are laterally spaced apart relative to each other in the operative boarding position.

20. A boarding ladder assembly for attachment to a boat in an operative boarding position, comprising in combination:

a base ladder section;

a climbing ladder section coupled to the base ladder section;

a first support bracket adapted for installation at a first attachment location on a boat, the first support bracket including portions for releasably engaging the base ladder section and providing hanging support thereto in the operative boarding position; and a second support bracket adapted for attachment at a second attachment location on a boat, the second support bracket including portions for releasably engaging the climbing ladder section and opposing shifting movement thereof in the operative boarding position, wherein the first support bracket includes a single hook member, and the second support bracket comprises a first latch member and a second latch member that are laterally spaced apart relative to each other in the operative boarding position.

21. A boarding ladder assembly for attachment to a boat in an operative boarding position, comprising in combination:

a base ladder section;

a climbing ladder section coupled to the base ladder section;

a first support bracket adapted for installation at a first attachment location on a boat, the first support bracket including portions for releasably engaging the base ladder section and providing hanging support thereto in the operative boarding position; and a second support bracket adapted for attachment at a second attachment location on a boat, the second support bracket including portions for releasably engaging the climbing ladder section and opposing shifting movement thereof in the operative boarding position, wherein the second support bracket comprises a resilient gripping latch made of a moldable polymer material.

* * * * *